US005477881A

United States Patent [19]

Fujinaka et al.

[11] Patent Number: 5,477,881

[45] Date of Patent: Dec. 26, 1995

[54] TANK FOR PUMP

[75] Inventors: Yoshiaki Fujinaka, Tokyo; Yukio Maruyama, Saitama; Yoshikazu Shimazu, Urawa, all of Japan

[73] Assignee: Iwaki Co., Ltd., Tokyo, Japan

[21] Appl. No.: 302,183

[22] Filed: Sep. 8, 1994

[30] Foreign Application Priority Data

Sep. 10, 1993 [JP] Japan ..... 5-054193 U

[51] Int. Cl.[6] ..... B67D 5/40

[52] U.S. Cl. ..... 137/565; 220/603; 220/23.83; 222/383.1

[58] Field of Search ..... 137/565; 220/23.83, 220/603; 222/383.1, 383.2

[56] References Cited

U.S. PATENT DOCUMENTS

| | | | |
|---|---|---|---|
| 1,645,525 | 10/1927 | Fleming | 220/603 X |
| 3,366,280 | 1/1968 | Sampson et al. | 222/383.1 X |
| 3,713,585 | 1/1973 | Conklin | 222/383.1 X |
| 4,135,647 | 1/1979 | Mascia et al. | 222/383.1 X |
| 4,819,833 | 4/1989 | Huddleston et al. | 222/383.1 X |
| 4,872,582 | 10/1989 | Sipple | 220/603 |
| 5,050,757 | 9/1991 | Hidding et al. | 220/23.83 |

FOREIGN PATENT DOCUMENTS

| | | |
|---|---|---|
| 0141564 | 5/1985 | European Pat. Off. . |
| 3337379 | 4/1985 | Germany . |
| 7142404 | 3/1972 | Netherlands . |
| 2209183 | 5/1989 | United Kingdom . |

*Primary Examiner*—John Rivell
*Attorney, Agent, or Firm*—Jones, Tullar & Cooper

[57] ABSTRACT

A tank for a pump is disclosed, which can accommodate a fluid for pumping, such as a chemical liquid. To a lower portion of a tank body which has a pump accommodation recess formed on one side, a weight member is removably secured. Prior to the securing, at the tank installation site the inner space of the weight member is filled with a weight material, such as water or sand, through an opening formed in the upper portion of the weight member. By so doing, when the residual quantity of the fluid for pumping in the tank body of the tank after the installation is reduced to be small, the tank is held in stable state by the weight of the weight member.

6 Claims, 3 Drawing Sheets

TANK FOR PUMP

BACKGROUND OF THE INVENTION

This invention relates to a tank for a pump, which accommodates a fluid for pumping, such as a chemical, and used with a small size pump.

This type of tank is used with a pump in a system for quantitatively pumping a fluid such as a chemical. In the site of installation of the tank, the pump is installed on the tank top, for instance, for saving the installation space. Further, the tank is secured in position by an anchor bolt in the installation site.

As this type of tank, a synthetic resin molding is used, which is comparatively light in weight. Therefore, when the residual quantity of fluid for pumping in the tank becomes small, the balance of the tank is deteriorated, and the tank may be displaced or turned down when it is touched from the outside or by strong winds in case where it is installed outdoors. Particularly, where the pump is installed on top of the tank as in the prior art use, the centroid of the tank is at a high position, and the possibility of the displacement or turning-down of the tank is increased. Where the fluid for pumping in the tank is a chemical or a chemical compound, the turning-down of the tank may bring about a grave accident.

The installation of the tank, therefore, requires an operation of securing the tank with anchor bolts of the like. When the tank is installed on a roof or an existing equipment, it is necessary to newly mount anchor bolts or the like, thus leading to cost increase. Actually, in many cases the tank is left without being secured. Further, when the tank is installed on the ground surface, it can not be sufficiently secured with anchor bolts.

SUMMARY OF THE INVENTION

An object of the invention is to provide a tank for a pump, which can be installed in a stabler state, can be positively prevented from its occasional displacement or turning-down and can be readily installed.

To attain the above object, according to the invention there is provided a tank for a pump, which comprises a tank body having a pump accommodation recess formed on one side and accommodating a pump, the tank body accommodating a fluid for pumping, a weight member provided under the tank body, and a mounting means for removably securing an upper portion of the weight member and a lower portion of the tank body.

According to the invention, there is also provided a tank for a pump, in which the weight member has an inner space capable of being filled with a weight material such as water or sand and an opening formed in the top of it and communicating with the inner space for introducing the weight material into the inner space.

According to the invention, there is further provided a tank for a pump, in which the top of the weight member is formed with a support surface for supporting the pump accommodated in the pump accommodation recess.

According to the invention, there is still further provided a tank for a pump, in which the mounting means includes a mounting stud provided on the underside or lower portion of the tank body, a mounting hole formed in the top surface portion or the upper portion of the weight member and penetrated by the mounting stud, and a threaded cap removably screwed on the mounting stud penetrating the mounting hole.

According to the invention, there is yet further provided a tank for a pump, in which the mounting means includes guide rails provided on the top surface portion of the weight member and slide grooves formed adjacent to the underside of the tank body.

In the tank for a pump according to the invention, the weight member is removably secured to the underside of the pump body accommodating a fluid for pumping such as a chemical. The tank is transported to the installation site in a state that the tank body and the weight member are removed from each other. At the installation site, water, sand, etc. is charged into the weight member through the opening provided at the top of the weight member. Then, the tank body is set on the weight member, and the two are secured to each other with the mounting means. The pump is disposed not on top of the tank body but in the pump accommodation recess provided therein on one side.

In the installed state of the tank, the weight member accommodating water, sand, etc. is founded under the tank body. The centroid of the whole tank is thus at a lowered position, the weight member providing a function of a weight. Thus, even when the residual quantity of fluid in the tank is reduced, the tank is not readily displaced or turned down by being touched from the outside or by the influence of strong winds in case where it is installed on a roof, and it is held stably. Further, the pump itself is disposed in the pump accommodation recess, the position of the centroid of the tank is correspondingly lowered, thus providing for stability reinforcement.

It is thus possible to prevent occasional displacement or turning-down of the tank due to touch from the outside, strond winds, etc. Further, the installation of the tank does not require any separate securing operation with anchor bolts or the like. In addition, there is no restriction on the site of installation. Further, the tank can be readily transported to the installation site. Further, in the installed state of the tank the weight member corresponds in shape to the peripheral shape of the tank body, while the pump is accommodated in the pump accommodation recess. Thus, the tank is compact in its installed state and requires a reduced installation space.

The above features and advantages of the invention will be more fully understood from the detailed description of the preferred embodiments when the same is read with reference to the accompanying drawings.

DETAILED DESCRIPTION OF THE PREFERRED EMBODIMENTS

Figure 1:
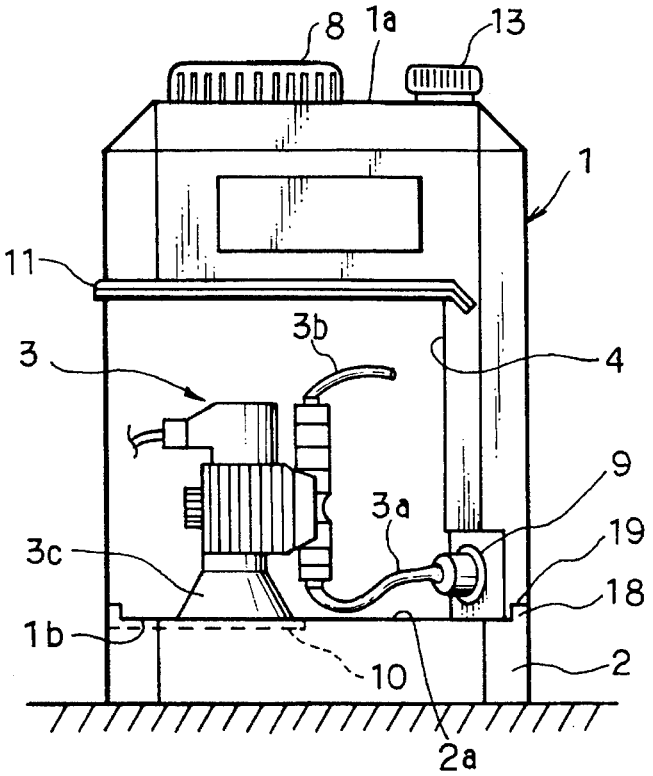
FIG. 1 is a front view showing a first embodiment of the tank for a pump according to the invention in the installed state that a weight member is mounted with respect to a tank body and that the pump is accommodated in a pump accommodation recess.
Figure 2:
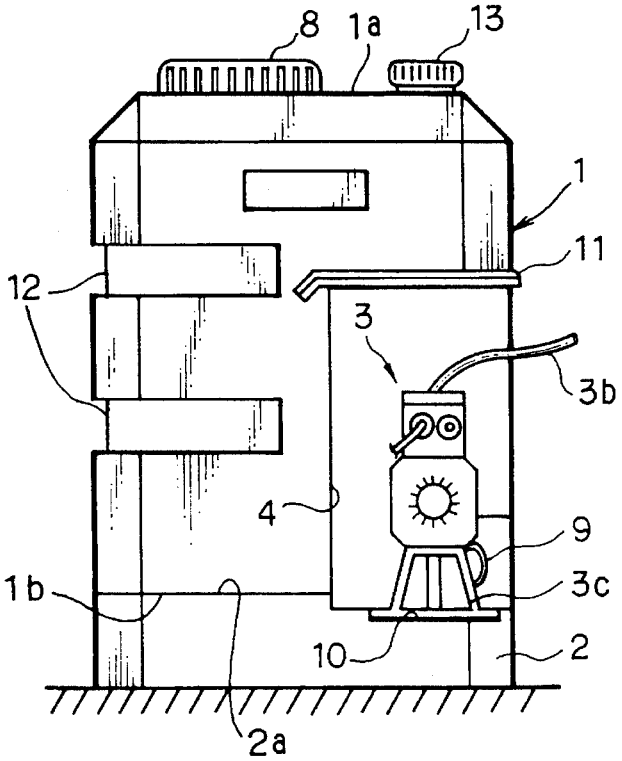
FIG. 2 is a left side view showing the same embodiment.

Now, a first and a second embodiment of the tank for a pump according to the invention will be described with reference to the drawings. The first embodiment will first be described with reference to FIGS. 1 to 4. FIGS. 1 and 2 show the tank for a pump in the installed state. Designated at 1 is a rectangular tank body with chamfered corners, at 2 is a weight member mounted under the tank body 1 and having the same peripheral shape as that of the tank body 1, and at 3 a pump accommodated in a pump accommodation recess 4 formed in the tank body 1 on one side thereof. The pump 3 is an electromagnetically driven fixed rate pump or like small size pump.

Figure 3:
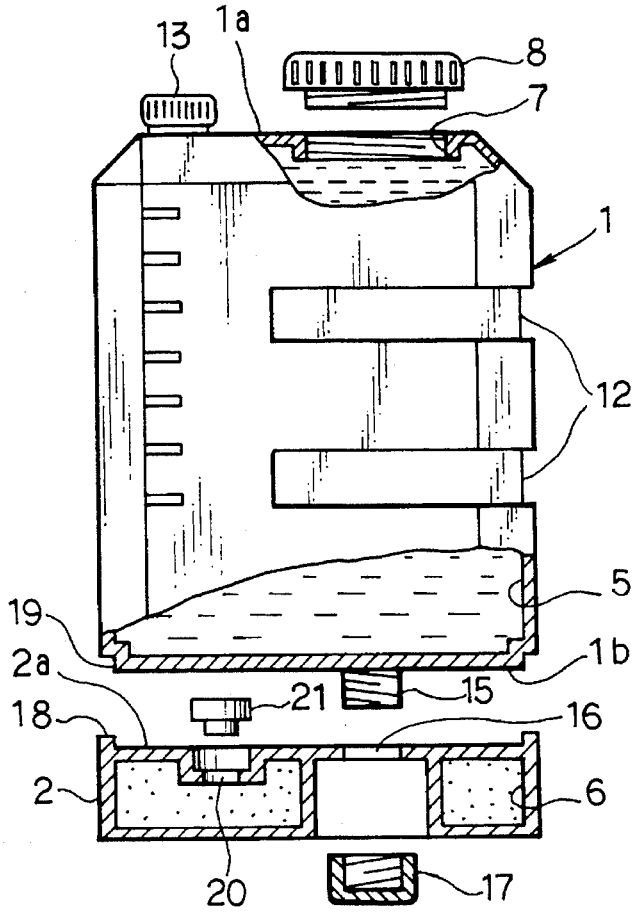
FIG. 3 is an exploded back side view, partly broken away, showing the same embodiment of the tank for a pump with the weight member removed.

The tank body 1 and weight member 2 are formed as respective one-piece moldings of a synthetic resin. As shown in FIG. 3, the tank body 1 has an inner tank chamber 5 for accommodating a fluid for pumping, such as a chemical liquid. The weight member 2 has an inner space 6, into which water, sand, etc. functioning as a weight is charged.

A fluid for pumping, such as a chemical liquid, is charged into the tank chamber 5 through a fluid inlet 7 provided in a top wall 1*a* of the tank body 1 by removing a cap 8. The fluid is supplied from a fluid supply port 9 shown in FIG. 1 through a suction side ductline 3*a* of the pump 3 into the pump 3 and thence pumped through a discharge side ductline 3*b* to a destination locality (not shown).

The pump accommodation recess, as shown in FIGS. 1 and 2, has a size such that the accommodated pump 3 does not project from the outer surface of the tank body 1. Although not shown, the zone of the recess 4 is covered, with the pump accommodated therein, by a transparent cover along the same outer surface as the tank body 1. With this arrangement, it is possible to protect the pump from rainwater in case where the tank is installed outdoors. The pump 3 has a leg 3*c* which is supported on a pump support surface 10 formed in a top surface portion or upper portion 2*a* of the weight member 2. The support surface 10 may have a stepped shape for engagement with the leg 3*c* of the pump. With this arrangement, the pump may be mounted on and secured to the support surface 10 without any bolt or like securing member. While in this embodiment the support surface 10 is provided in the top surface portion 2*a* of the weight member 2, as an alternative it is possible to provide the pump accommodation recess 4 of the tank body 1 with a floor serving as a support surface on which to install the pump.

Eaves 11 which are integral with and project from the upper edge of the pump accommodation recess 4 of the tank body 1, prevent intrusion of rainwater into the recess 4 in case where the tank is installed outdoors. Designated at 12 are ribs provided on the side surfaces of the tank body 1 for reinforcing the mechanical strength of the tank body 1.

A cap 13 provided on the top portion la of the tank body 1 is removed when checking the residual amount of the accommodated fluid.

Figure 4:
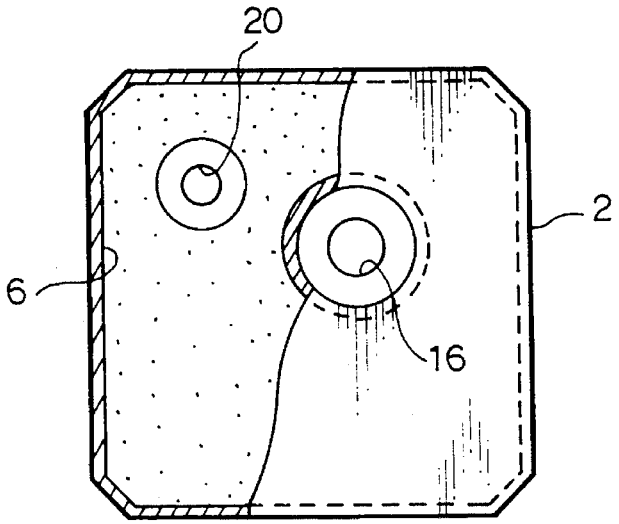
FIG. 4 is a bottom view, partly broken away, showing the weight member.

Referring to FIGS. 3 and 4, mounting means for removably securing the tank body 1 and the weight member 2 to each other is provided, which includes a mounting stud 15 projecting from the underside or the lower portion 1*b* of the tank body 1, a mounting hole 16 formed in the upper portion 2*a* of the weight member 2, and a threaded cap 17 which is screwed on the mounting stud 15. When mounting the tank body 1 and the weight member 2 with respect to each other, the mounting stud 15 is inserted through the mounting hole 16, and then the cap 17 is screwed from below on the stud 15. In this way, the tank body 1 and the weight member 2 can be easily secured to each other. For prescribing the mounting position, the weight member 2 has a rib 18 integral with the top edges, while the tank body 1 has a shoulder 19 formed along the lower end edges. With the engagement of the rib 18 and the the shoulder 19, the tank body 1 and the weight member 2 can be secured to each other such that they will not be laterally deviated from each other.

Before mounting the tank body 1 on the weight member 2, a weight material such as water or sand serving the role of a weight is charged into the inner space 6 of the weight member 2 by removing a plug 21 from the opening 20 provided in the top wall portion 2*a* as shown in FIG. 3. Then, after closing again the opening 20 with the plug 21, the tank body 1 is mounted on the weight member 2.

Since the opening 20 is provided in the top wall portion 2*a*, the weight material such as water or sand serving the role of a weight can be charged into the inner space 6 up to the upper end position thereof.

To make the tank ready for use at the installation site, the weight material such as water or sand is charged into the inner space 6 of the weight member 2, then the tank body 1 and the weight member 2 are secured to each other with the mounting means, and then the weight member 2 is installed on the installation site floor. Then, the pump 3 is disposed in the pump accommodation recess 4, then the suction side ductline 3*a* is connected to the fluid supply port 9, and a fluid for pumping such as a chemical liquid is charged into the tank chamber 5 in the tank body 1. The tank body 1 becomes lighter in weight as the residual amount of fluid in the tank chamber 5 is reduced. However, the weight member 2 serves the role of a weight to positively prevent occasional displacement or turning-down of the tank due to touching thereof from the outside or by strong winds.

By increasing the height size of the weight member 2 it is possible to increase the amount of the weight material such as water or sand charged into the inner space 6 and thus obtain an effect of a greater weight. The height size can be suitably set by taking the tank installation status, extents of external forces applied, etc. into appropriate considerations. As a modified structure of the weight member 2, the member may not have any inner space but may be solid.

Figure 5:
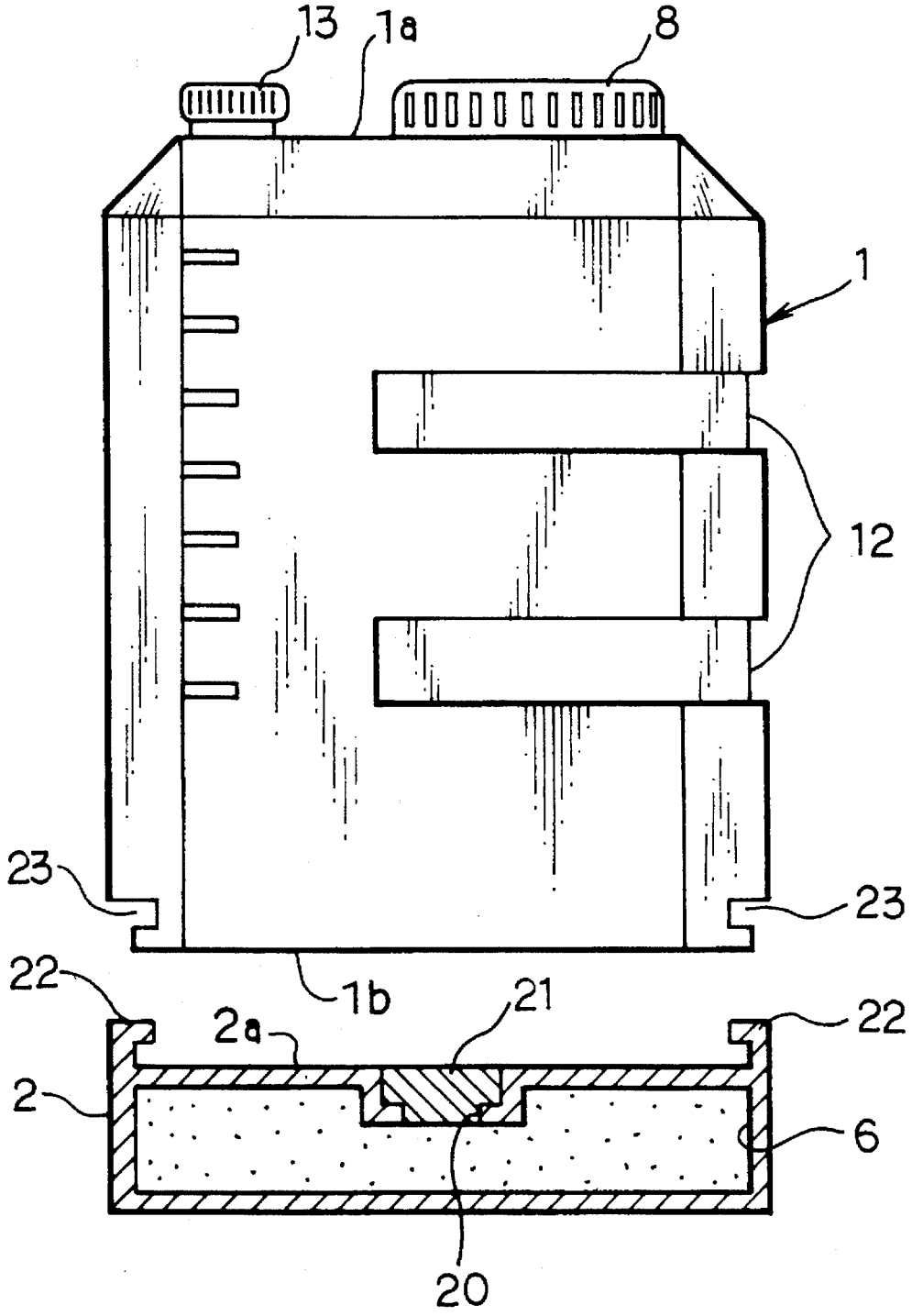
FIG. 5 is a view similar to FIG. 3 but showing a second embodiment of the tank with a pump provided with mounting means having a different structure.

FIG. 5 shows a second embodiment of the tank for a pump according to the invention. This embodiment comprises mounting means, which include opposite side straight guide rails formed on the top 2*a* of weight member 2 along the opposite edges thereof and opposite side slide grooves 23 formed adjacent to the bottom 1*b* of tank body 1 along the opposite edges thereof such as to correspond to the guide rails 22.

The tank body 1 may be mounted on the weight member 2 by causing the slide grooves 23 of the tank body 1 to slide along the corresponding guide rails 22 of the weight member 2. For regulating the mounting position, the sliding may be stopped at the end position by stoppers.

The mounting means in the first embodiment which includes the threaded cap 17 and the stud 15, has an advantage that it permits the mounting to be carried out easily and reliably by merely operating the cap 17. On the other hand, in the second embodiment in which the guide rails 22 and the slide grooves 23 are slide engaged, the reliability of mounting and securing is inferior compared to the first embodiment. However, there are advantages that no cap or like separate component is necessary and that the zone of the inner space 6 is increased in correspondence to the absence of the cap. In the second embodiment shown in FIG. 5, parts like those in the first embodiment are designated by like reference numerals and symbols.

While the first and second embodiments of the invention have been described, these embodiments are by no means limitative. For example, the peripheral shape of the tank body and the weight member is not limited to the rectangle, but it may be a circle or any other shape as well. With the weight member according to the invention, the tank can be installed in a sufficiently stable state at almost any installation site. However, if it is desired to perfectly secure the tank to the installation site, the weight member may be secured to the floor surface of the installation site with anchor bolts.

What is claimed is:

1. A tank for a pump comprising:

a tank body having a pump accommodation recess formed on one side and accommodating a pump, said tank body accommodating a fluid for pumping;

a weight member provided under said tank body; and mounting means for removably securing an upper portion of said weight member and a lower portion of said tank body.

2. The tank for a pump according to claim 1, wherein said weight member has an inner space capable of being filled with a weight material and an opening formed in the top of it and communicating with said inner space for introducing the weight material into said inner space.

3. The tank for a pump according to claim 2, wherein said weight material is a liquid or sand.

4. The tank for a pump according to claim 1, wherein the upper portion of said weight member is formed with a support surface for supporting the pump accommodated in said pump accommodation recess.

5. The tank for a pump according to claim 1, wherein said mounting means includes a mounting stud provided on the lower portion of said tank body, a mounting hole formed in the upper portion of said weight member and penetrated by said mounting stud, and a threaded cap removably screwed on said mounting stud penetrating said mounting hole.

6. The tank for a pump according to claim 1, wherein said mounting means includes guide rails provided on the upper portion of said weight member and slide grooves formed adjacent to the underside of said tank body.

* * * * *